US005542585A

United States Patent [19]

Peters et al.

[11] Patent Number: 5,542,585

[45] Date of Patent: Aug. 6, 1996

[54] DISPENSING CLOSURE WITH PIVOTABLY MOUNTED SPOUT AND MEANS FOR LIMITING TRAVEL THEREOF

[75] Inventors: Ray Peters, Woodlands, England; Woodrow S. Wilson, Johnston; Donald LaVange, Cumberland, both of R.I.

[73] Assignee: Polytop Corporation, Slatersville, R.I.

[21] Appl. No.: 298,263

[22] Filed: Aug. 31, 1994

[51] Int. Cl.[6] ..... B67D 3/00

[52] U.S. Cl. ..... 222/531; 222/533; 222/534; 222/556

[58] Field of Search ..... 222/212, 531, 222/533, 534, 556

[56] References Cited

U.S. PATENT DOCUMENTS 3,111,245 11/1963 Libit et al. ..... 222/534

3,881,643 5/1975 LaVange ..... 222/531 X 3,884,392 5/1975 Hazard ..... 222/534 X

*Primary Examiner*—Gregory L. Huson

*Attorney, Agent, or Firm*—Hoffman, Wasson & Gitler, P.C.

[57] ABSTRACT

Dispensing closure comprising a cap including an upper surface and a depending skirt adapted to be secured to a dispenser, a spout with an enlarged base and an elongated body, and mounting members, such as trunnions and a cavity defined within the upper surface of the cap, to secure the spout in the cavity for pivotal movement. A lug is formed on the spout, and a stop is defined within the cavity; the lug and stop cooperate to positively limit the travel of the spout toward a vertical orientation. A scoop, or enlarged opening, at the inlet end of the spout enables the contents of the container to be discharged through the spout, even when the base of the spout partially eclipses the opening the cap that communicates with the interior of the dispenser.

2 Claims, 2 Drawing Sheets

FIG. 1
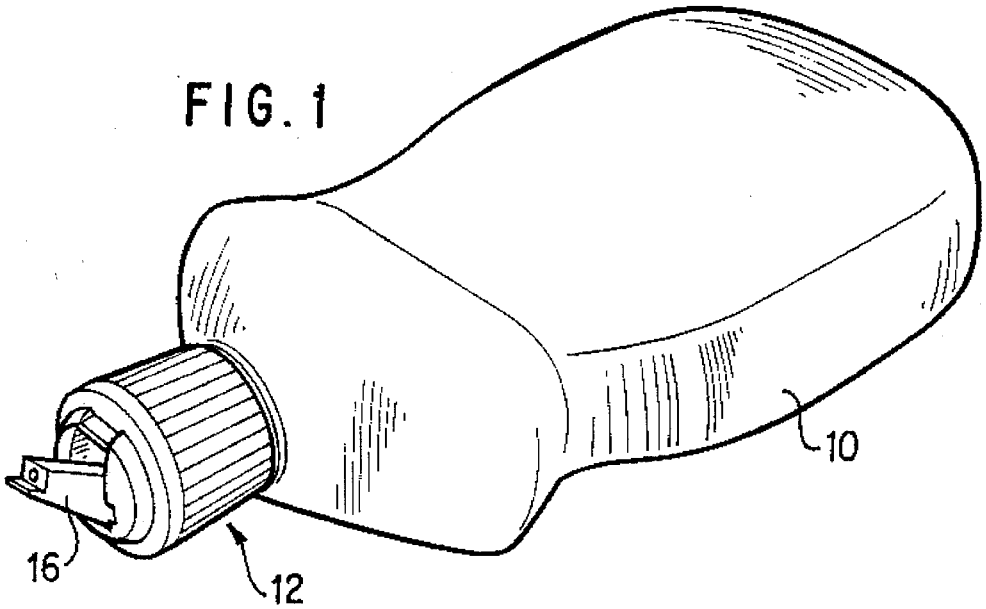
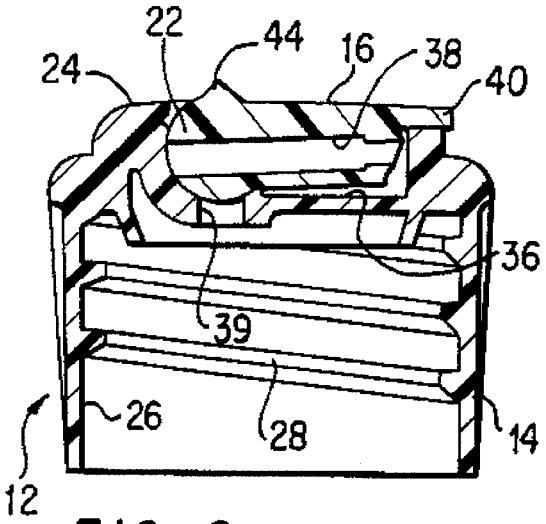
FIG. 2
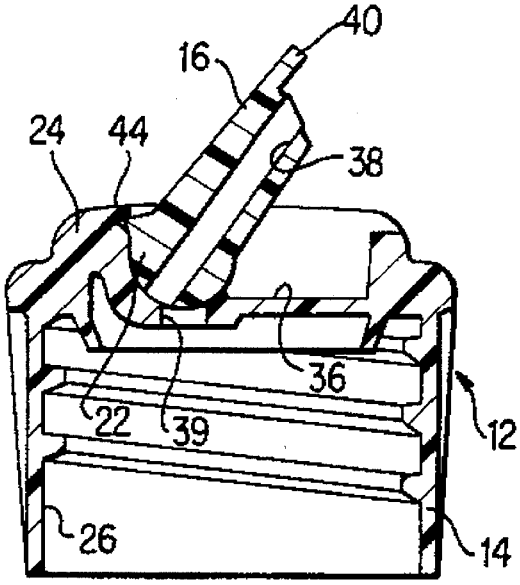
FIG. 3
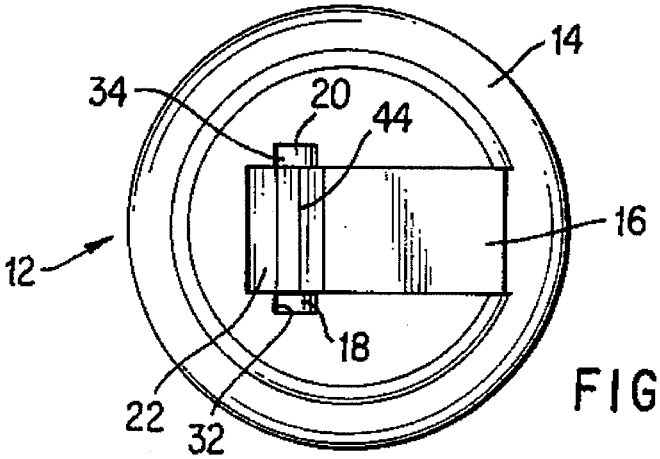
FIG. 4

DISPENSING CLOSURE WITH PIVOTABLY MOUNTED SPOUT AND MEANS FOR LIMITING TRAVEL THEREOF

FIELD OF THE INVENTION

This invention pertains generally to dispensing closures with pivotably mounted spouts, and more particularly to cooperating lugs and stops that positively limit the movement of the spout relative to the cap.

BACKGROUND OF THE INVENTION

One known type of dispensing closure that has gained consumer acceptance for dispensing a variety of products is the spouted dispensing closure. Such dispensing closures, which are executed in plastic, in high volume and at relatively low cost, comprise, primarily, (1) a cap that is adapted to be secured to the neck of a container, and (2) a spout that is mounted in a cavity on the upper surface of the cap. The spout comprises an enlarged, usually cylindrical base, and a central passage extends throughout the spout. An opening is formed in the cap to allow communication with the interior of the container. Trunnions extend laterally from opposite sides of the base, and are received in sockets defined in the walls of the cavity on the cap. The trunnions and sockets enable the spout to be pivoted through a 90° arc relative to the cap. The spout is usually retained in its horizontal, closed position, wherein the cylindrical base seals the opening in the cap; however, when the user wishes to discharge the contents of the container, the spout is pivoted 90° to its vertical position, which places the central passage in the spout in alignment with the opening in the cap.

A representative dispensing closure, employing a pivotably mounted spout, is disclosed in U.S. Pat. No. 3,111,245, granted Nov. 19, 1963, to Sidney Libit and Arthur Newby. Such patent discloses a closure comprising, principally, a base (10) that is screwed into the neck of a bottle (20), and a spout (11) that is moved, or pivoted, relative thereto. The spout is received in a cavity (25) defined on the upper surface of the cap, and the cylindrical knuckle, or base, of the spout is retained therein. A bore (57) extends through the spout, as shown in FIG. 4, and a bore (60) is formed through the cap to establish communication with the interior of the knuckle, or base, as shown in FIG. 6. Movement of the spout to its "on" or discharge position is limited by the engagement of pad (31) with an indentation in the spout 11, as shown in FIG. 3. When the spout is in its vertical position, the bores (57, 60) are aligned, and the product retained in the container can be discharged. When the spout is pivoted downwardly, the bores are misaligned and discharge is not possible, for the base of the spout blocks the bore (60) in the cap.

Other representative dispensing closures employing a pivotably mounted spout are disclosed in U.S. Pat. No. 4,209,114, U.S. Pat. No. 4,219,138, and in U.S. Pat. No. 4,756,451. These three patents, and the present application, are assigned to Polytop Corporation.

U.S. Pat. No. 4,756,451 employs a rib (54), or lug, located on the exposed surface of the cylindrical base of the spout, to facilitate opening same. The rib is uniquely configured so that sufficient purchase is available to allow the spout to be rotated to its vertically oriented, discharge position, wherein the bore (46) of the spout is aligned with the opening (34) in the bottom wall of the cavity that receives the base of the spout. The path of travel of the spout is shown in FIG. 3 of the Wilson '451 patent. Additional ribs on the spout, and on the upper surface of the cap, impart a child resistant safety characteristic to the spouted closure, as well.

Known dispensing closures, employing pivotably mounted spouts, including those cited and discussed above, invariably require that the spout be pivoted into a vertical position before discharge can occur. Only in the vertical position is the central passage in the spout fully aligned with the opening in the cap that communicates with the interior of the container for the product to be dispensed.

The known dispensing closures employing pivotably mounted spouts are ill-designed to meet the challenge of discharging a product at an angle of less than 90° to the horizontal. The angular discharge would be advantageous in discharging a cleanser under the rim of a toilet bowl, in discharging oven cleansers, in discharging lubricants, waxes, polishes, etc and in other applications where the product being discharged would tend to fall, or drip, back onto the user.

SUMMARY OF INVENTION

In accordance with the present invention, cooperating surfaces are defined between the spout and the cap of a dispensing closure to retain the spout in an opened position that is inclined at far less than 90° to the horizontal plane of the closure. In the preferred embodiment, the cooperating surfaces assume the form of a lug defined on the spout and a stop defined in the cylindrical cavity of the cap that receives the spout. The lug and the stop may limit the pivotal movement of the spout to 45°, or less, above the horizontal plane, and in extreme cases, may limit such movement to 15°–20° above the horizontal plane.

Additionally, the lug and the stop may be complementary in shape, and may thus provide a positive stop for the spout. The positive stop is a tactile signal that the spout is fully opened, even though it is tilted only 15°–20° above the horizontal plane of the cap. The cap may be executed in a slightly softer, more resilient material, that yields to allow the lug to be seated in the stop, or recess, in the cap, with an audible, clicking sound.

In the open position of the present invention, the cylindrical base of the spout partially eclipses, blocks, or overlays, the bore through the cap that opens into the cavity that receives the spout. An enlarged scoop is formed at the inlet end of the spout, and such scoop provides greater access to the bore in the spout. The scoop compensates for the partial eclipsing of the bore in the cap, back pressure is reduced, and the product may be discharged freely even though the bores are not in complete alignment.

Other advantages attributable to the present invention will become apparent to the skilled artisan when the appended drawings are construed in harmony with the ensuing detailed description of the invention.

BRIEF DESCRIPTION OF THE DRAWINGS

FIG. 1 is a perspective view of a conventional container with a preferred embodiment of a dispensing closure constructed in accordance with the principles of the present invention being secured thereto, such dispensing closure being shown in its opened position;

FIG. 2 is a vertical cross-sectional view of the dispensing closure of FIG. 1, on a larger scale, such dispensing closure being shown in its closed position;

FIG. 3 is a vertical cross-sectional view of the dispensing closure of FIG. 1, on a larger scale, such dispensing closure being shown in its opened position;

FIG. 4 is a top plan view of the dispensing closure of FIG. 2;

DESCRIPTION OF THE PREFERRED EMBODIMENT

Figure 5:
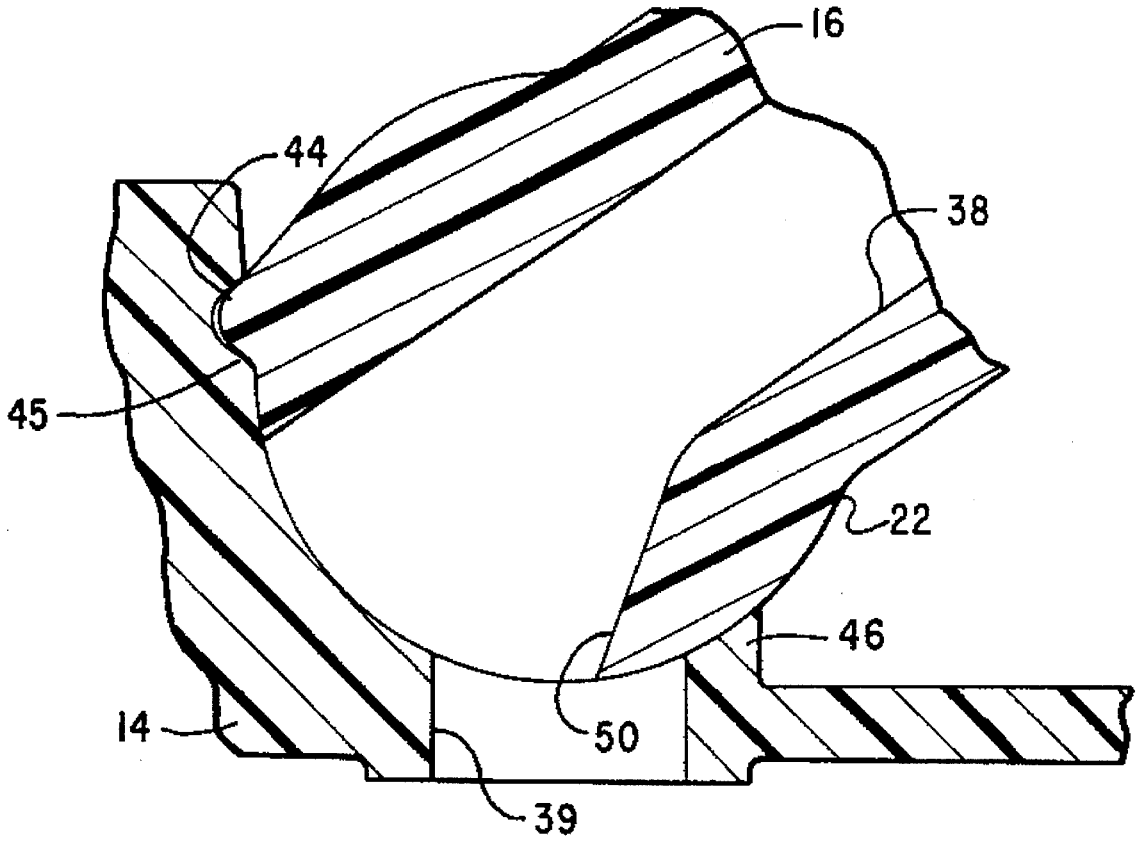
FIG. 5 is a fragmentary, vertical cross-sectional view of the spout and the cap of the dispensing closure of FIGS. 1–4, such view showing the cooperating lug and stop that positively retain the spout in an opened position.

FIG. 1 depicts a plastic container 10 that receives a dispensing closure 12, in threaded engagement, upon its neck. The container may be formed of plastic, and may be squeezed by the user to facilitate discharge through dispensing closure 12.

As shown in FIGS. 2–4, dispensing closure 12 comprises cap 14 with spout 16 secured thereto by trunnions 18, 20 projecting laterally from opposite sides of enlarged, cylindrical base 22.

Cap 14 comprises an upper surface 24 with a cavity to receive spout 12, and a depending skirt 26. Internal threads 28 are defined within the skirt, and threads 28 are advanced onto complementary threads on the neck of the container to which the cap is affixed.

Sockets 32, 34 in the cap receive trunnions 18, 20 when the spout is snapped, or forced, into engagement with the cap. The trunnions and sockets cooperate to enable the spout to be pivoted between its closed position in cavity 36 in cap 14, and its opened position, shown in FIG. 3. Trunnions 18, 20 and sockets 32, 34 are shown in FIG. 4.

Spout 16 includes an enlarged cylindrical base 22 and a central passage 38; the passage extends clear-through the spout. Passage 38 communicates with central opening, or bore, 39 in cap 14 when spout 16 is pivoted to its opened position. Such pivotal movement is achieved by lifting up on the projecting lip 40, and the contents of container 10 may be discharged through the discharge port 42 of central passage 38 in spout 16. Projecting lip 40 cooperates with the annular wall on cap 14 to define the closed position for spout 16. The lip is engaged by the user to pivot the spout to its opened portion.

Lug 44 is semi-circular when viewed in vertical cross-section, and extends upwardly above the exposed surface of the base of spout 16. When spout 16 is pivoted into its opened position shown in FIGS. 3 and 5, lug 44 fits within stop 45 formed in the wall of cap 14 adjacent to the base of the spout, but below lip 48. Lug 44, and stop 45, define the opened position for spout 16 and limit its pivotal movement to 20°–45°, above a horizontal plane passing through cap 14. The angular orientation of spout 16 renders the dispensing closure of FIGS. 1–4 ideally suited for discharging toilet bowl cleanser, oven cleaner, and other preparations that are discharged with the dispenser advantageously held below the surface to be treated.

Recess 45 is generally semi-circular in shape, and is slightly larger than lug 44. Cap 14 is usually formed of a plastic that is somewhat softer than the plastic from which the spout is molded; the cap may be executed in polyethylene and the spout may be executed in polypropylene. Thus, lug 44 snaps into recess 45 and produces an audible, clicking sound. Also, when lug 44 is seated properly in recess 45, the spout is positively locked in its opened position, and the user can tactiley sense such position.

Figure 6:
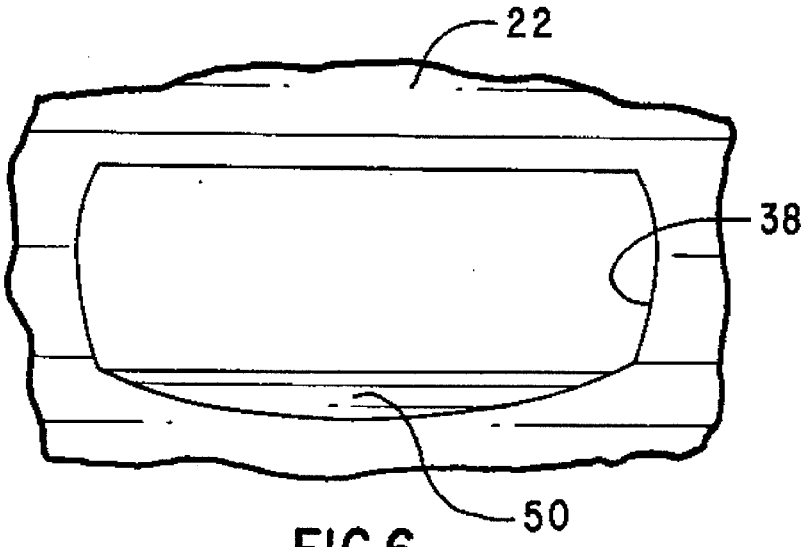
FIG. 6 is an end view of a fragment of the spout, such view showing the scoop formed at the inlet end of the spout.

FIG. 5 reveals that bore 38 in spout 16 is not fully aligned with bore 39 in cap 14 when the spout is in its opened position. Enlarged base 22 of the spout 16 partially overlaps bore 39, and eclipses same. An enlarged entrance to the inlet end of passage 38 was developed to compensate for the eclipsing interaction. Such entrance is shaped like a scoop, and is identified by reference numeral 50 in FIGS. 5 and 6.

Scoop 50 functions as a funnel for directing product passing through bore 39 in cap 14 into the inlet end of passage 38 in spout 16. The scoop increases the cross-sectional area of passage 38 at its inlet end, and relieves back pressure, if any should be formed during passage of the product through the spout. After the spout has been pivoted to its closed position, excess product retained in passage 38 may drain slowly through bore 39 and pass downwardly into the interior of the container.

Scoop 50 is formed by placing a molding pin in the proper position during molding; the molding pin can be withdrawn from the mold easily, and the scoop is accurately formed.

While a preferred embodiment of the invention has been described in considerable detail, various modifications may occur to the skilled artisan. For example, the base of the spout, and the cavity in the cap receiving same, may be spherical in shape. Lug 44, and stop 45 may be shaped differently, and stop 45 may be located closer to the lip 48, or farther therefrom, to alter the opened position, and angular orientation of spout 16. Consequently, the appended claims should be construed in a liberal fashion, consistent with the spirit and scope of the invention, and should not be limited to their literal terms.

We claim:

1. A dispensing closure comprising;

a) a cap including an upper surface and a depending skirt adapted to be secured to a dispenser, b) said upper surface including walls defining a cavity therein, and a bore defined through said cap to establish communication between the interior of the dispenser and said cavity, c) a spout with an enlarged base and an elongated body, d) a passage extending through said spout and terminating at the free end of said body, e) mounting means defined between said cylindrical base of said spout and said walls defining said cavity to permit said spout to be received within said cavity for pivotal movement therein, f) stop means defined on said spout and within said cavity to positively limit the travel of said spout toward to a vertical orientation, g) said stop means limiting the pivotal movement of said spout to a position wherein the enlarged base of said spout eclipses a portion of said bore to reduce communication between said bore and said passage in said spout, h) the invention being characterized by an enlarged scoop formed at the inlet end of said spout, said scoop compensating for the eclipsing of a portion of said bore by said enlarged base of said spout.

2. A dispensing closure as defined in claim 1 wherein said stop means comprises a lug formed on said spout and a stop situated within said cavity, and the invention is further characterized by said stop means being located in the path of rotation for said lug at a position below the upper surface of said cap.

* * * * *